US005777532A

United States Patent [19]

Lakin

[11] Patent Number: 5,777,532

[45] Date of Patent: Jul. 7, 1998

[54] INTERDIGITAL SLOW WAVE COPLANAR TRANSMISSION LINE

[75] Inventor: Kenneth Meade Lakin, Redmond, Oreg.

[73] Assignee: TFR Technologies, Inc., Bend, Oreg.

[21] Appl. No.: 783,047

[22] Filed: Jan. 15, 1997

[51] Int. Cl.[6] ..... H01P 1/18; H01P 3/08

[52] U.S. Cl. ..... 333/161; 333/238

[58] Field of Search ..... 333/156, 161, 333/140, 138, 204, 240, 238, 246; 385/2; 361/290, 303

[56] References Cited

U.S. PATENT DOCUMENTS

| | | | |
|---|---|---|---|
| 3,805,198 | 4/1974 | Gewartowski et al. | 333/204 |
| 4,340,873 | 7/1982 | Bastida | 333/161 |
| 4,460,880 | 7/1984 | Turner | 333/161 X |
| 5,150,436 | 9/1992 | Jaeger et al. | 385/2 |
| 5,485,131 | 1/1996 | Fajen et al. | 333/204 X |
| 5,489,880 | 2/1996 | Swarup | 333/204 X |

*Primary Examiner*—Seungsook Ham
*Attorney, Agent, or Firm*—G. Joseph Buck

[57] ABSTRACT

A coplanar microwave transmission line on a substrate utilizes the interdigital capacitance between overlapped conducting fingers that extend from the conductors of the transmission line to reduce substantially the velocity of electromagnetic waves propagating on the transmission line without introducing prohibitive losses. The arrays of fingers extending from the conductors of the transmission line substantially overlap each other and are relatively densely packed. Layered substrates may be used to provide lower loss and a substantial reduction in velocity, which layered substrates may include layers of dielectric material located both above and below the conductors of the transmission line.

17 Claims, 5 Drawing Sheets

INTERDIGITAL SLOW WAVE COPLANAR TRANSMISSION LINE

BACKGROUND OF THE INVENTION a. Field of the Invention

This invention pertains to microwave coplanar transmission lines. More particularly this invention pertains to the use of interdigital capacitance to create slow wave microwave coplanar transmission lines.

b. Description of the Prior Art

In U.S. Pat. No. 5,150,436 ("436"), Jaeger and Lee describe a microwave coplanar transmission line that is used in combination with adjacent optical waveguides to modulate the electromagnetic waves at optical frequencies that are propagating in the adjacent optical waveguides. The "436" coplanar transmission line consists of two, parallel conducting strips located upon the surface of a substrate. Each conducting strip includes conducting fingers that extend towards the other conducting strip. The capacitance between the conducting fingers attached to the two strips adds to the capacitance between the conducting strips. However, because the lineal dimensions of the conducting fingers are oriented more or less at right angles to the longitudinal dimension of the transmission line, the conducting fingers alter the capacitance between the parallel conducting strips without altering, to the same extent, the inductance exhibited by the parallel conducting strips. As a consequence, the additional capacitance between the conducting strips, that is provided by the conducting fingers, reduces the phase velocity at which electromagnetic waves propagate along the coplanar transmission line.

The "436" patent discloses the use of the fingers to reduce by a relatively small amount the phase velocity of the microwave signal propagating along the coplanar transmission line for the purpose of matching more nearly the velocity of an electromagnetic wave at optical frequencies that is propagating within the adjacent optical waveguides.

In the preferred embodiment of the "436" patent, FIG. 5 depicts an end to end configuration of the fingers in which each of the fingers has an enlarged end. At column 4, lines 32 thru 35, the "436" patent discloses that for the end to end configuration, the ratio of l to d, i.e. the ratio of the narrow dimension of each finger ("fin") to the offset of each finger from the adjacent finger on the same strip, should normally be less than ½ and more preferably less than ¼ and at column 6, lines 33 thru 38, discloses that the fingers on each strip should be widely spaced from each other so as to minimize unwanted interactions between neighboring fingers ("fins"). Because of the limitations on the ratio of l to d, and because of the end to end arrangement of the fingers in the preferred embodiment, the reduction in phase velocity that may be achieved by the use of fingers as disclosed in the preferred embodiment of the "436" patent is limited.

The "436" patent, in FIG. 2, also depicts the use of conducting fingers 28C attached to the two conducting strips in which the fingers attached to one conducting strip substantially overlap the fingers attached to the second conducting strip. However, in this instance where the fingers substantially overlap each other, the ratio of "l" to "d" is approximately 1 to 15. Such widely spaced fingers are referred to in the within specification as "sparse" fingers. The "436" patent does not disclose the use of substantially overlapped fingers that are closely spaced, i.e. that are dense.

SUMMARY OF THE INVENTION

In contrast to the fingers disclosed in the "436" patent, the coplanar microwave transmission line of the present invention utilizes relatively dense arrays of conducting fingers configured such that the array of fingers attached to one conducting strip and the array of fingers attached to the second conducting strip overlap with each other for a substantial portion of the lengths of these fingers. In the present invention the ratio of "l" to "d" for such substantially overlapped fingers is much less than 1 to 15, i.e. of the order of 1 to 4. By using dense arrays of fingers and by substantially overlapping the arrays of fingers so as to form "interdigital capacitors", the present invention reduces the phase velocity of the electromagnetic wave propagating along the transmission line by a factor of as much as 10 or more.

In the present invention, the phase velocity can be further reduced by locating the conducting strips and the dense arrays of substantially overlapping fingers on a substrate having a high relative dielectric constant. Because this invention uses dense arrays of overlapped fingers, an electromagnetic wave propagating along the transmission line generates electric "fringing" fields that are localized in and near to the narrow gaps between adjacent fingers that contain the major portion of the electric energy within the propagating wave. As a consequence, only a relatively thin, surface layer of the substrate, in which the major portion of the fringing fields are located, need have a low dielectric loss in order for the invention to exhibit a substantial reduction in phase velocity without prohibitive losses. As a consequence the substrate can be layered, with the surface-most layer having a low dielectric loss and the remaining bulk of the substrate having a higher dielectric loss. Because a substantial portion of the magnetic fields normally will extend into the bulk of the substrate, the material comprising the bulk of the substrate may be selected so as to provide low magnetic losses and perhaps higher relative magnetic permeability with lesser regard to whether or not such material has low dielectric losses. Thus the use of dense arrays of overlapping fingers allows one to select a combination of materials, one having low dielectric losses and the other having low magnetic losses, which combination provides a relatively low-loss coplanar transmission line.

In one embodiment of the present invention the conducting strips of the transmission line are fabricated to be as much as ten or more times the thickness of the fingers so as to make the thickness of the conducting strips two or three times the skin depth of the propagating electromagnetic wave. This additional thickness of the conducting strips further reduces the losses associated with the transmission line.

Another embodiment of the present invention consists of a central conducting strip located between two conducting strips that act as grounds. The central conducting strip has conducting fingers extending from each side of the central conductor and that are interlaced with conducting fingers extending from the two grounded conducting strips.

Still another embodiment of the present invention also includes a layer of dielectric material deposited on top of the transmission line. The additional layer of high dielectric constant material on top of the transmission line further reduces the propagation velocity.

These various embodiments of the present invention provide slow-wave, relatively low loss, transmission lines.

DETAILED DESCRIPTION

Figures 1A, 1B, 1C:
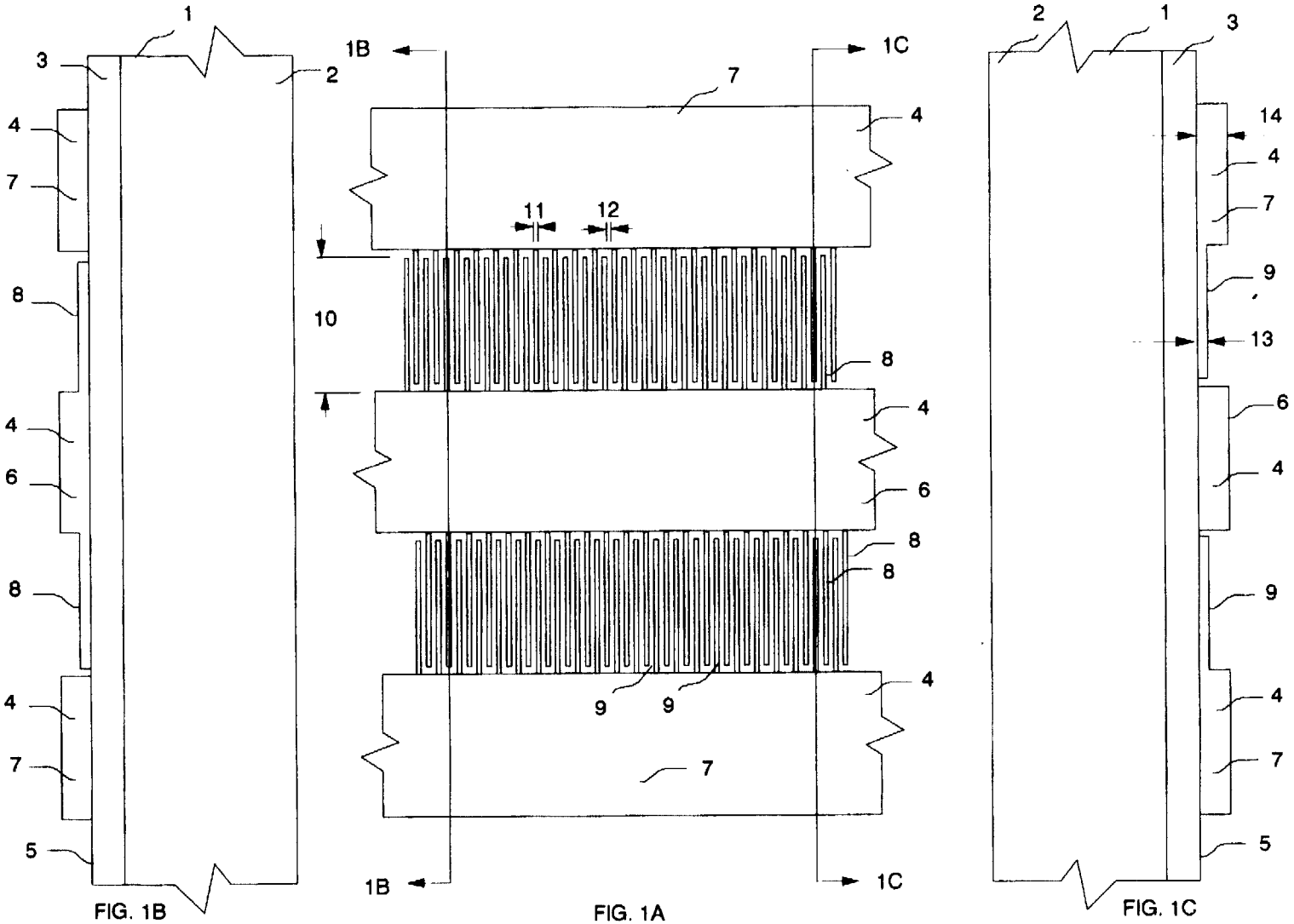
FIGS. 1A, 1B and 1C depict the preferred embodiment of the invention in the form of a transmission line consisting of three conducting strips located on a substrate, the central conducting strip being located between two grounded conducting strips.

Referring now to FIGS. 1A, 1B and 1C which depict the preferred embodiment of the invention. Substrate 1 is comprised of two layers, a thick layer 2 of a material such as gallium arsenide (GaAs), silicon, sapphire or other similar material which typically has a relatively low dielectric constant of 10 or so and which also may have a relatively high dielectric loss coefficient. Layer 2 is covered by a thin layer 3 of a material such as aluminum oxide (alumina) having a similar relative dielectric constant, but having a much lower dielectric loss coefficient. Either or both layers of substrate 1 also could be made of a material such as barium titanate or titanium dioxide which typically have a relatively high dielectric constant in the approximate range of 80 to 100. A transmission line 4 is located on the upper surface 5 of substrate 1. Transmission line 4 consists of a conducting strip 6 that is located between two conducting strips 7. Conducting strips 7 normally operate as the "grounded" portion of the transmission line and conducting strip 6 is the "excited" or "hot" portion of the transmission line.

In the preferred embodiment, conducting fingers 8 extend from conducting strip 6 at approximately right angles from the longitudinal dimension of conducting strip 6 and are located on the upper surface of substrate 1. In a similar fashion, conducting fingers 9 extend from conducting strips 7. As depicted in FIG. 1A, fingers 8 are interlaced with fingers 9. Fingers 8 and 9 are relatively long and narrow and relatively densely packed such that a substantial portion of the length of each finger 8 is located adjacent to an adjacent finger 9. In the preferred embodiment the length 10 of a typical finger 8 or 9 is approximately ten times the width 11 of the finger and the width of the gap 12 between comparable fingers is approximately equal to the width 11 of the typical finger. Because the lengths 10 of the fingers are substantially greater than the widths 11 of the fingers, and because the fingers 8 substantially overlap fingers 9, the major portion of the capacitance between the conductors forming transmission line 4 is concentrated within the "fringing fields" located in close proximity of gaps 12. As a consequence, layer 3 of substrate 1 need only be two or three times as thick as the size of gaps 12 in order to contain most of the electric fields of the transmission line within the low dielectric loss layer 3 and thus provide a relatively low loss, slow-wave transmission line.

It should be noted that in all of the figures, the vertical dimensions (i.e. normal to the surface of the substrate) of the embodiments of the invention are not drawn to the same scale as the horizontal dimensions, but instead are greatly exaggerated in order to allow their depiction on the same drawings.

Conducting strips 6 and 7 and the conducting fingers 8 and 9 may be fabricated by normal microelectronic fabrication techniques such as etching or "lift-off".

If fingers 8 and 9 are fabricated by using chemical etching techniques, then the thickness 13 of conducting fingers 8 and 9 is restricted by the widths 12 of the fingers. In order to avoid substantial undercutting of the fingers, thickness 13 must normally be less than approximately one-tenth of width 12. In the preferred embodiment, conducting strips 6 and 7 are fabricated so as to make the thickness 14 of conducting strips 6 and 7 to be two to three times the skin depth of the propagating electromagnetic wave, which thickness 14 may be as much as ten or more times the thickness 13 of conducting fingers 8 and 9. The greater thickness 14 of the conducting strips may, for example, be obtained by electroplating additional metal upon the conducting strips after the fingers have been fabricated by chemical etching. The relatively greater thickness 13 of conducting strips 6 and 7 reduces the losses associated with the conduction of currents within these strips thus providing a lower loss transmission line that still utilizes densely packed, interlaced conducting fingers.

Although the preferred embodiment includes a surface layer comprised of a low-loss, high dielectric material superimposed upon a higher loss substrate, it should be understood that the substrate need not be composed of multiple layers. Furthermore, although in the preferred embodiment, conducting strips 6 and 7 have greater thicknesses than conducting fingers 8 and 9, these thicknesses need not be different. Although conducting fingers 8 and 9 are depicted in FIG. 1A as extending at approximately right angles from conducting strip 6, it should be understood that other orientations could be used.

Figure 2C:
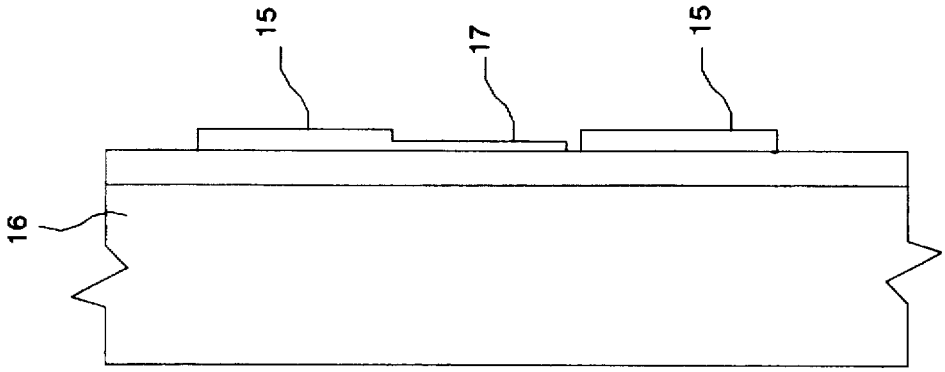
FIGS. 2A, 2B and 2C depict a second embodiment of the invention in the form of a balanced, two-conductor, transmission line located on a substrate.
Figure 2A:
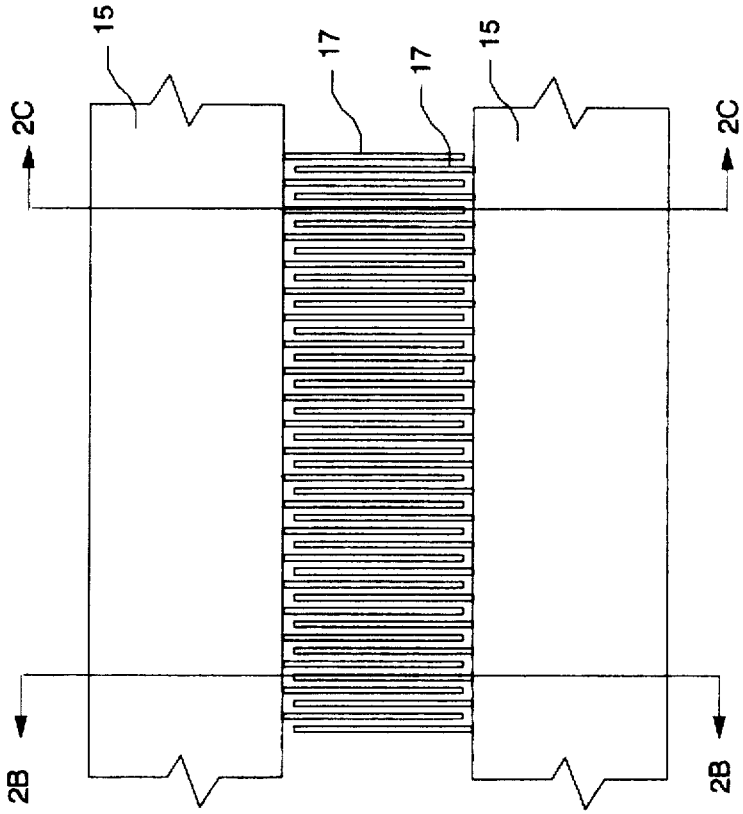
Figure 2B:
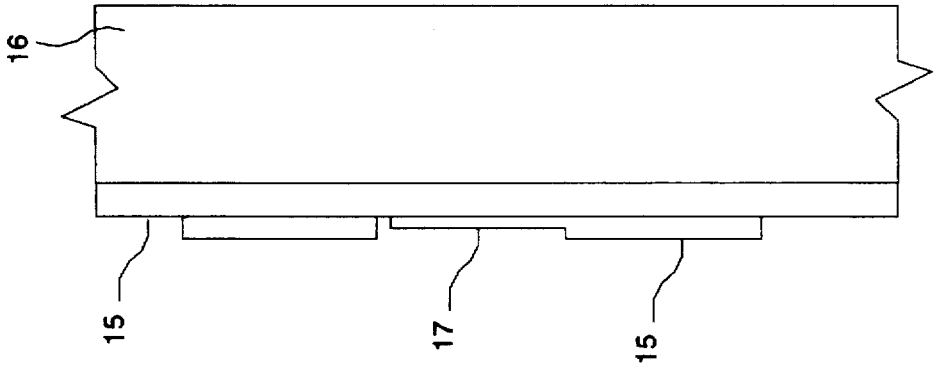

FIGS. 2A, 2B and 2C depict another embodiment of the invention in which the transmission line is a balanced transmission line consisting of two conducting strips 15 located upon substrate 16. Conducting fingers 17 extend from each conducting strip 15 and the conducting fingers 17 from each conducting strip are interlaced with the other to form "interdigital" capacitors.

Figure 3:
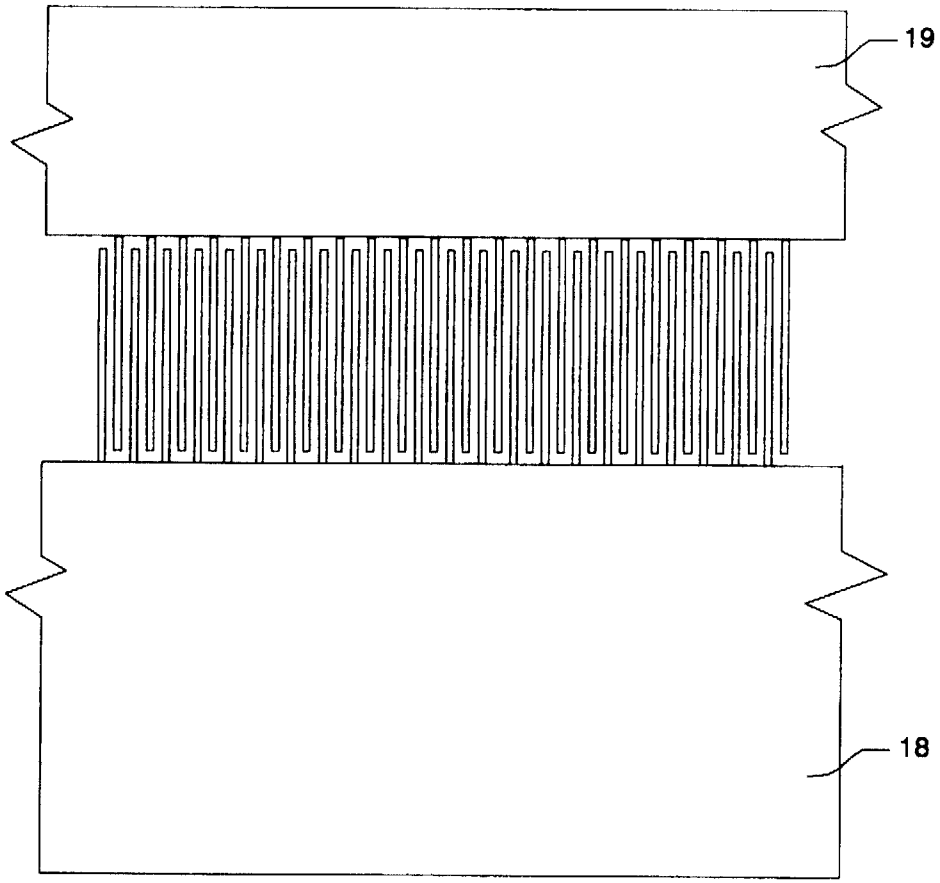
FIG. 3 is a top view of the conductors in a third embodiment of the invention in the form of an unbalanced, two-conductor, transmission line located on a substrate, in which the larger of the two conductors operates as a ground.

FIG. 3 is a top view of the conductors in still another embodiment of the invention in which the transmission line is an unbalanced transmission line consisting of two conducting strips located on a substrate. Conducting strip 18 is much wider than conducting strip 19 and typically operates as the "grounded" side of the unbalanced transmission line. As in the other embodiments of the invention, conducting fingers extend from the conducting strips and are interlaced with each other.

Figure 4:
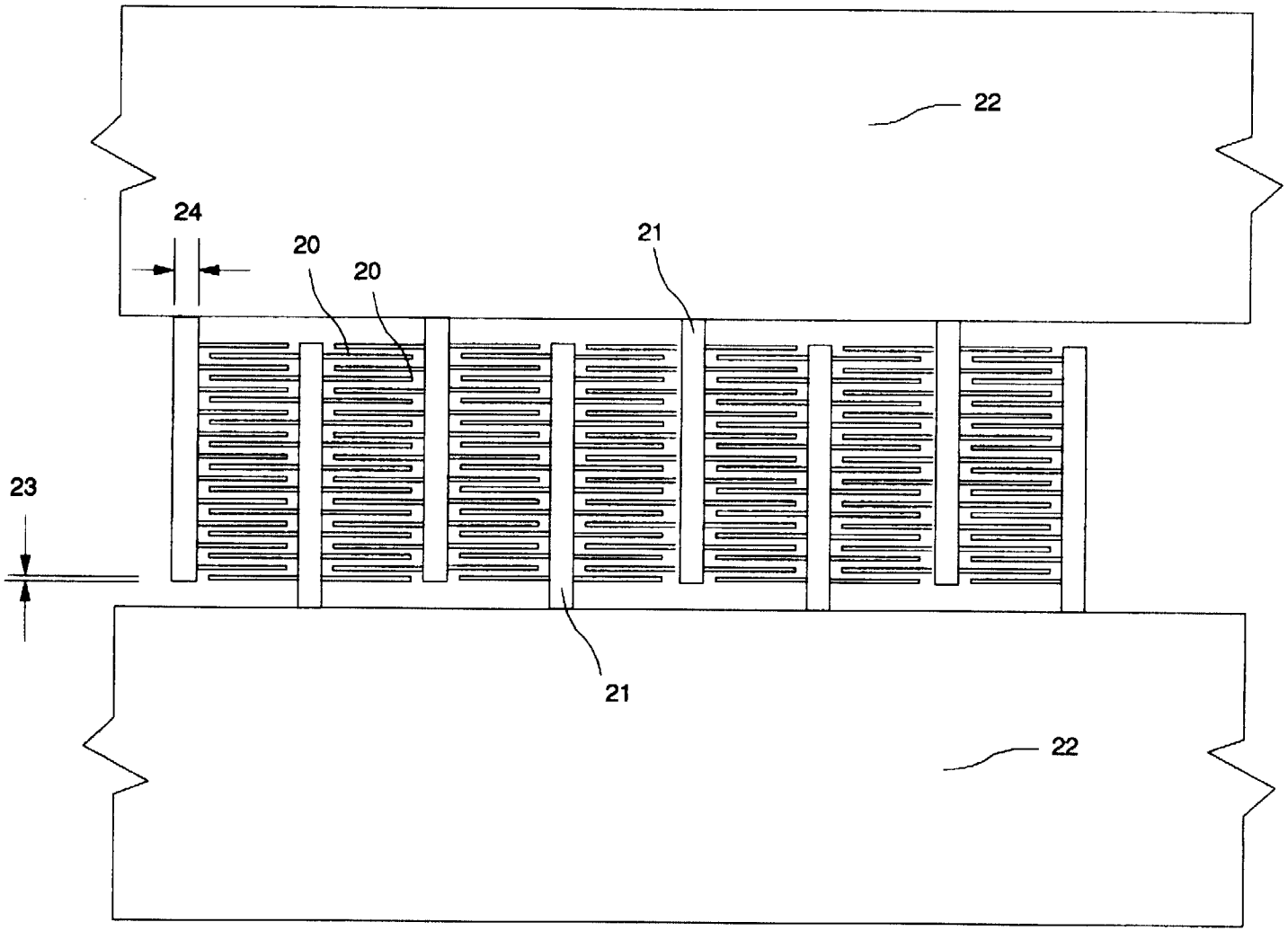
FIG. 4 depicts a fourth embodiment of the invention in which densely packed arrays of fingers extend from conducting bars connected to the conducting strips.

FIG. 4 depicts an embodiment of the invention that utilizes overlapping arrays of fingers 20 to form the interdigital capacitors. Fingers 20 are conductively connected to conducting bars 21, which bars 21 are, in turn, conductively connected to conducting strips 22, all of which are placed upon the surface of an underlying substrate and together form a coplanar transmission line. For the purpose of clarity in FIG. 4, the relative dimensions of conducting bars 20 are not drawn to the same scale as fingers 20. In the actual device, the width 23 of fingers 20 may be of the order of a few microns while the width 24 of conducting bars 20 may be of the order of tens of microns. Correspondingly, although in FIG. 4, 11 fingers are shown as being attached to each conducting bar 20, in the actual device there may be as many as a few hundred fingers attached to each conducting bar. The narrow widths of the fingers confines the fringing fields between adjacent fingers to a very thin layer of the substrate, while at the same time the greater widths of the conducting bars reduces the conductive losses associated with the interdigital capacitors. Because the conducting bars are wider, they may also be made thicker, which greater thickness further reduces the conductive losses within the device.

Figure 5:
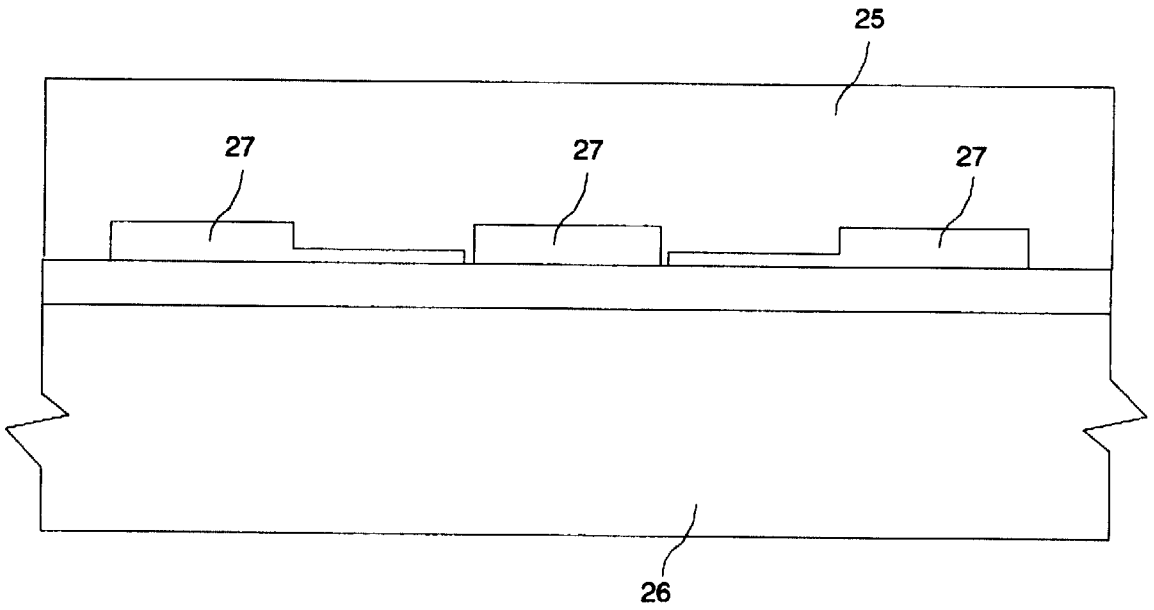
FIG. 5 is a cross-sectional view of a fifth embodiment of the invention in which a layer of dielectric material has been placed over the upper surface of the transmission line.

Finally, FIG. 5 depicts a cross-sectional view of an embodiment of the invention in which an additional layer 25 of dielectric material has been placed on top of substrate 26 and the conducting strips and fingers 27. Layer 25 further increases the capacitance between the conducting fingers and further decreases the velocity of the electromagnetic wave propagating along the transmission line. Sputtering or other techniques may be used to deposit layer 25 upon the upper surface of the device.

It should be understood that although the various embodiments of the invention are described as having "planar" surfaces, the "planar" surfaces need not be flat, but instead could be curved in some manner or another.

I claim:

1. An electromagnetic wave transmission line comprising:

a substantially non-conducting substrate having an upper surface, a first conducting strip located on the upper surface of the substrate and having a plurality of lateral conducting fingers electrically connected to the first conducting strip and located on the upper surface of the substrate, said plurality of conducting fingers, wherein said first set and second set of conducting fingers being positioned substantially transverse to the direction of electromagnetic wave propagation constituting a first set of conducting fingers, a second conducting strip located on the upper surface of the substrate and having a plurality of lateral conducting fingers electrically connected to the second conducting strip and located on the upper surface of the substrate, said plurality of conducting fingers constituting a second set of conducting fingers, the second conducting strip being located in a position substantially parallel to the first conducting strip and the first set of conducting fingers being interlaced with the second set of conducting fingers but without the first set of conducting fingers being conductively connected to the second set of conducting fingers, the first set of conducting fingers being interlaced with the second set of conducting fingers to the extent that the location of the first set of conducting fingers substantially overlaps the location of the second set of conducting fingers and the spacing on both sides of the fingers between adjacent interlaced fingers being less than the length of the overlap of the adjacent interlaced fingers.

2. The device of claim 1 and further including a third conducting strip located on the upper surface of the substrate and having a plurality of lateral conducting fingers electrically connected to the second conducting strip and located on the upper surface of the substrate, said plurality of conducting fingers constituting a third set of conducting fingers, the third conducting strip being located in a position substantially parallel to the first conducting strip, the first conducting strip further including a plurality of lateral conducting fingers electrically connected to the first conducting strip and constituting a fourth set of conducting fingers, the third set of conducting fingers being interlaced with the fourth set of conducting fingers but without the third set of conducting fingers being conductively connected to the fourth set of conducting fingers, the third set of conducting fingers being interlaced with the fourth set of conducting fingers to the extent that the location of the third set of conducting fingers substantially overlaps the location of the fourth set of conducting fingers and the spacing on both sides of the fingers between adjacent interlaced fingers being less than the length of the overlap of the adjacent interlaced fingers.

3. The device of claim 1 wherein the spacing between successive fingers connected to each conducting strip is less than five times the widths of said fingers.

4. An electromagnetic wave transmission line comprising:

a first substantially non-conducting substrate having a dielectric constant and having an upper surface, a second substantially non-conducting substrate having upper and lower surfaces, the lower surface of the second substrate being located upon the upper surface of the first substrate, a first conducting strip located on the upper surface of the second substrate and having a plurality of lateral conducting fingers electrically connected to the first conducting strip and located on the upper surface of the second substrate, said plurality of conducting fingers constituting a first set of conducting fingers, a second conducting strip located on the upper surface of the second substrate and having a plurality of lateral conducting fingers electrically connected to the second conducting strip and located on the upper surface of the second substrate, said plurality of conducting fingers constituting a second set of conducting fingers, the second conducting strip being located in a position substantially parallel to the first conducting strip and the first set of conducting fingers being interlaced with the second set of conducting fingers but without the first set of conducting fingers being conductively connected to the second set of conducting fingers, the first set of conducting fingers being interlaced with the second set of conducting fingers to the extent that the location of the first set of conducting fingers substantially overlaps the location of the second set of conducting fingers and the spacing on both sides of the fingers between adjacent interlaced fingers being less than the length of the overlap of the adjacent interlaced fingers, wherein said first set and second set of conducting fingers being positioned substantially transverse to the direction of electromagnetic wave propagation.

5. An electromagnetic wave transmission line comprising:

a substantially non-conducting substrate having an upper surface, a first conducting strip located on the upper surface of the substrate and having a plurality of lateral conducting bars electrically connected to the first conducting strip and located on the upper surface of the substrate and having a plurality of conducting fingers electrically connected to each conducting bar, a second conducting strip located on the upper surface of the substrate and having a plurality of lateral conducting bars electrically connected to the second conducting strip and located on the upper surface of the substrate and having a plurality of conducting fingers electrically connected to each of said conducting bars, the second conducting strip being located in a position substantially parallel to the first conducting strip and the conducting fingers that are electrically connected to the first conducting strip being interlaced with the conducting fingers that are electrically connected to the second conducting strip, wherein said plurality of of lateral conducting bars being positioned substantially transverse to the direction of electromagnetic wave propagation.

6. The device of claim 1 and further including a layer of dielectric material overlying the conducting fingers.

7. The device of claim 1 in which the thicknesses of the conducting strips is greater than the thicknesses of the conducting fingers.

8. The device of claim 2 and further including a layer of dielectric material overlying the conducting fingers.

9. The device of claim 2 in which the thicknesses of the conducting strips is greater than the thicknesses of the conducting fingers.

10. The device of claim 3 and further including a layer of dielectric material overlying the conducting fingers.

11. The device of claim 3 in which the thicknesses of the conducting strips is greater than the thicknesses of the conducting fingers.

12. The device of claim 4 and further including a layer of dielectric material overlying the conducting fingers.

13. The device of claim 4 in which the thicknesses of the conducting strips is greater than the thicknesses of the conducting fingers.

14. The device of claim 5 and further including a layer of dielectric material overlying the conducting fingers.

15. The device of claim 5 in which the thicknesses of the conducting strips is greater than the thicknesses of the conducting fingers.

16. The device of claim 4 in which the second substantially non-conducting substrate has a lower dielectric loss than the dielectric loss of the first substrate.

17. The device of claim 4 in which the first substantially non-conducting substrate has a relative magnetic permeability that is greater than the relative magnetic permeability of the second substantially non-conducting substrate.

* * * * *

UNITED STATES PATENT AND TRADEMARK OFFICE

CERTIFICATE OF CORRECTION

PATENT NO. : 5,777,532
DATED : July 7, 1998
INVENTOR(S) : Kenneth Meade Lakin

It is certified that error appears in the above-identified patent and that said Letters Patent is hereby corrected as shown below:

Claim 1 is corrected as follows:

i) Beginning in line 8 of claim 1 appearing at line 22, column 5 of the patent, the following punctuation and words are deleted:

", wherein said first set and second set of conducting fingers being positioned substantially transverse to the direction of electromagnetic wave propagation"

ii) At the end of claim 1, i.e. in line 32 of claim 1 appearing at line 46, column 5 of the patent, immediately after the word "fingers", the following words and punctuation are inserted:

--, wherein said first set and second set of conducting fingers being positioned substantially transverse to the direction of electromagnetic wave propagation--

Signed and Sealed this

Fourteenth Day of September, 1999

*Attest:*

Q. TODD DICKINSON

*Attesting Officer*

*Acting Commissioner of Patents and Trademarks*